US006510839B1

(12) United States Patent
Pursifull

(10) Patent No.: US 6,510,839 B1
(45) Date of Patent: Jan. 28, 2003

(54) ELECTRONIC THROTTLE SPRING TORQUE ADAPTATION SYSTEM

(75) Inventor: Ross Dykstra Pursifull, Dearborn, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/973,446

(22) Filed: Oct. 9, 2001

(51) Int. Cl.[7] ..... F02D 7/10
(52) U.S. Cl. ..... 123/399; 318/561; 123/339.25
(58) Field of Search ..... 123/361, 399, 123/339.25; 318/561

(56) References Cited

U.S. PATENT DOCUMENTS 4,745,899 A 5/1988 Kiuchi et al.
4,854,283 A 8/1989 Kiyono et al.
4,875,447 A 10/1989 Kiuchi et al.
4,884,541 A 12/1989 Marriott
4,941,444 A 7/1990 Fujita
5,033,431 A * 7/1991 Poirier et al. ..... 123/339.24
5,157,956 A 10/1992 Isaji et al.
5,213,077 A 5/1993 Nishizawa et al.
5,311,849 A 5/1994 Lambert et al.
5,463,298 A 10/1995 Kamio et al.
5,517,966 A * 5/1996 Kanazawa et al. ..... 123/396
5,669,351 A * 9/1997 Shirai et al. ..... 123/339.21
5,875,762 A * 3/1999 Tsuchiya et al. ..... 123/339.25
6,223,719 B1 * 5/2001 Yano et al. ..... 123/339.14

* cited by examiner

*Primary Examiner*—Erick R. Solis

(57) ABSTRACT

A method for controlling a positioning device of an internal combustion engine includes the an electric motor for actuating the positioning device. The electric motor actuates the positioning device against the spring bias torque. A first current is supplied to the electric motor to move the motor to an actual position. The actual position of the throttle plate is compared to a requested position. The first current is monitored to determine the required current to oppose the spring torque at the actual position. The requested position is summed with a spring opposition term based upon the required current into a adjusted requested position. Finally, a current is supplied to the electric motor to move the positioning device to an adjusted requested position.

16 Claims, 4 Drawing Sheets

ELECTRONIC THROTTLE SPRING TORQUE ADAPTATION SYSTEM

TECHNICAL FIELD

The present invention relates generally to control systems for internal combustion engines, and more particularly, to an electronic throttle spring torque adaptation system.

BACKGROUND ART

Many previously known motor vehicle throttle control systems have a direct physical linkage between an accelerator pedal and the throttle body so that the throttle plate is pulled open by the accelerator cable as the driver presses the pedal. The direct mechanical linkages include a biasing force that defaults the linkages to a reduced operating position, in a manner consistent with regulations. Nevertheless, such mechanisms are often simple and unable to adapt fuel efficiency to changing traveling conditions. Moreover, these mechanisms add significant weight and components to the motor vehicle.

An alternative control for improving throttle control and the efficient introduction of fuel air mixtures into the engine cylinders is presented by electronic throttle control. The electronic throttle control includes a throttle control unit that positions the throttle plate by an actuator controlled by a microprocessor based on the current operating state determined by sensors. The processors are often included as part of a powertrain electronic control that can adjust the fuel air intake and ignition in response to changing conditions of vehicle operation as well as operator control.

Typical electronic throttles include a biasing spring coupled to a throttle plate. The spring torque generated by this biasing spring is opposed by controlling a throttle plate actuator with a current (or voltage or H-driver duty cycle) to achieve the desired throttle plate position. Desired throttle plate position may be achieved by treating the spring torque as a disturbance torque and letting the integrator wind up to the required mean value necessary to oppose it. Unfortunately, treating the spring torque as a disturbance torque works poorly where the spring torque varies with throttle angle. To compensate for this, many systems resort to storing an invariant estimate of spring torque or spring torque variation in a look-up table.

The disadvantages associated with these conventional electronic throttle idle control techniques have made it apparent that a new technique for opposing electronic throttle spring torque is needed. The new technique should operate without dependence on an estimate of spring torque or spring torque variation. The present invention is directed to these ends.

SUMMARY OF THE INVENTION

It is, therefore, an object of the present invention to provide an improved and reliable electronic throttle spring torque adaptation system. Another object of the invention is to provide an electronic throttle control system that operates without dependence on an estimate of spring torque or spring torque variation.

In accordance with the above and other objects of the present invention, an electronic throttle spring torque adaptation system is provided. In one embodiment of the invention, a method for controlling a positioning device of an internal combustion engine includes providing an electric motor for actuating the positioning device. The electric motor actuates the positioning device against the spring bias torque. A first current is supplied to the electric motor to move the motor to an actual position. The actual position of the motor is then compared to a requested position. The first current is monitored to determine the required current to oppose the spring torque at the actual position. The requested position is summed with a spring opposition term based upon the required current into a adjusted requested position. Finally, current is supplied to the electric motor to move the motor to an adjusted requested position.

The present invention thus achieves an improved electronic throttle spring torque adaptation system. The present invention is advantageous since it automatically adjusts the controller for changes in electronic throttle spring torque.

Additional advantages and features of the present invention will become apparent from the description that follows, and may be realized by means of the instrumentalities and combinations particularly pointed out in the appended claims, taken in conjunction with the accompanying drawings.

BRIEF DESCRIPTION OF THE DRAWINGS

In order that the invention may be well understood, there will now be described some embodiments thereof, given by way of example, reference being made to the accompanying drawings, in which.

BEST MODES FOR CARRYING OUT THE INVENTION

Figure 1:
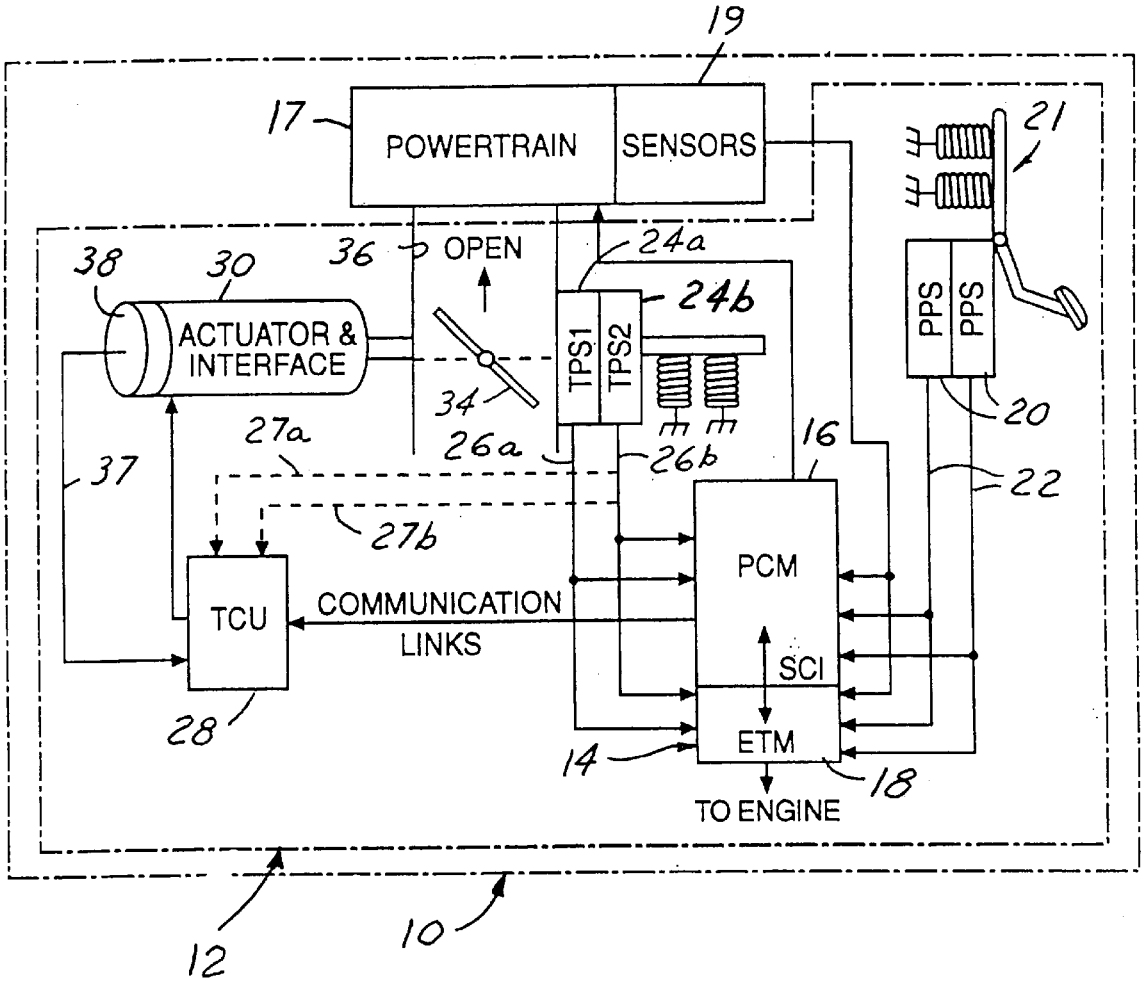
FIG. 1 is a schematic illustration of an electronic throttle spring torque adaptation system in accordance with one embodiment of the present invention.

In the following figures, the same reference numerals will be used to identify identical components in the various views. The present invention is illustrated with respect to an electronic throttle spring torque adaptation system, particularly suited for the automotive field. However, the present invention is applicable to various other uses that may require electronic throttle spring torque adaptation systems.

Referring to FIG. 1, a motor vehicle powertrain system 10, including electronic throttle control system 12, includes an electronic control unit 14. In the preferred embodiment, the electronic control unit 14 includes a powertrain control module (PCM) 16, including a main processor and an electronic throttle monitor (ETM) 18, including an independent processor. The PCM and ETM each share sensors 19 and actuators that are associated with the powertrain system 17 and control module 16. Preferably, the electronic throttle monitor 18 includes a processor physically located within the powertrain control module housing, although a separate housing, separate locations and other embodiments can also be employed in practicing the invention. Moreover, while the electronic throttle monitor 18 and the powertrain control module 16 have independent processors, they share the inputs and outputs of powertrain sensors 19 and actuators 21 and 34, respectively, for independent processing.

A wide variety of inputs are represented in the diagram of FIG. 1 by the diagrammatic representation of redundant pedal position sensors 20. The sensors 20 are coupled through inputs 22 and are representative of many different driver controls that may demonstrate the demand for power. In addition, the electronic control unit 14 includes inputs 26*a* and 26*b* for detecting throttle position. A variety of ways for providing such indications is diagrammatically represented in FIG. 1 by a first throttle position sensor 24*a* and a redundant second throttle position sensor 24*b* to obtain a power output indication. As a result of the many inputs represented at 19, 22, 26*a* and 26*b*, the electronic controller 14 provides outputs for limiting output power so that output power does not exceed power demand. A variety of outputs are also diagrammatically represented in FIG. 1 by the illustrated example of inputs to a throttle control unit 28 that in turn powers an actuator and motor interface 30 for displacing the throttle plate 34. For example, an actuator and interface may comprise redundant drive motors powering a gear interface to change the angle of the throttle plate 34 in the throttle body 36.

Likewise, the responsive equipment like motors may also provide feedback. For example, the motor position sensor 38 or the throttle position sensors 24*a* and 24*b* may provide feedback to the throttle control unit 28, as shown at 37, 27*a* and 27*b*, respectively, to determine whether alternative responses are required or to maintain information for service or repair.

Figure 2A:
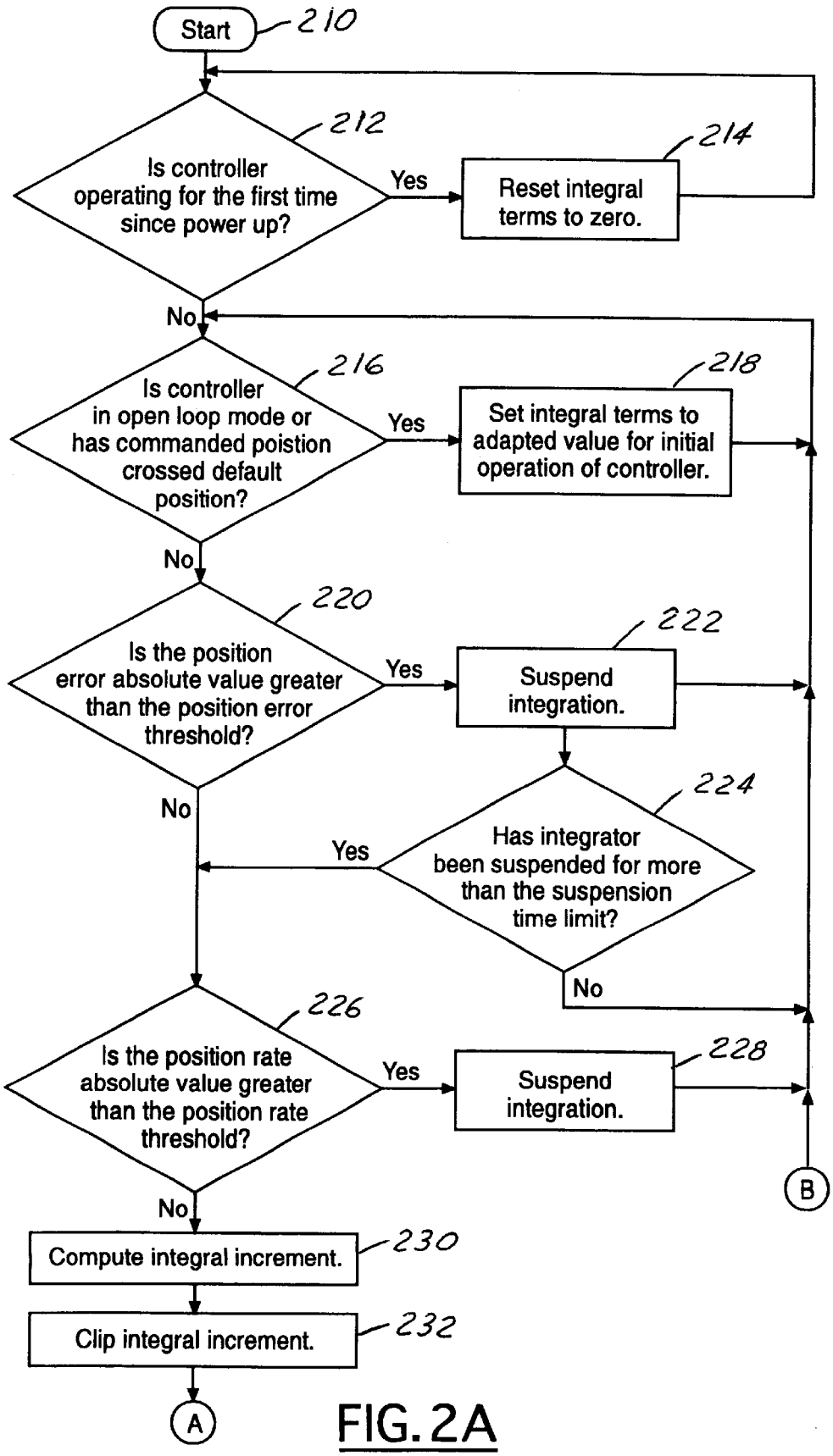
FIG. 2A is a first part of a logic flow diagram of an electronic throttle feedback controller for an electronic throttle control system, responsive to a throttle position command in accordance with one embodiment of the present invention.

Referring to FIG. 2A, a logic flow diagram of an electronic throttle feedback controller for an electronic throttle control system, responsive to a throttle position command in accordance with one embodiment of the present invention is illustrated. The method begins by inputting the throttle position command to the throttle control system 10. After the start 210 of the operation shown in FIG. 2A, a check is made in inquiry block 212 as to whether the controller is running for the first time since power up (control system activation). The position error is usually large following the initial input and this causes the integral to wind up. As a result, time is wasted waiting for the integral to unwind for normal control operation. For a positive answer in step 212, the sequence proceeds to step 214.

In step 214, the terms of the integration element are reset to zero pursuant to operation block 214. For example, the controller may execute the following commands:

integral_term_a=0 integral_term_b=0 adapted_integral_term_a=0 adapted_integral_term_b=0

After resetting the terms, the control method returns to inquiry block 212.

For a negative answer in step 212, a check is made in inquiry block 216 to determine if the controller is in an open loop mode or if the commanded position has crossed the default position. If the answer is positive, then the sequence proceeds to step 218.

In step 218, the controller sets the integral terms to the adapted value for first use after a period of nonuse. For example, the controller may execute the following commands:

integral_term_a=adapted_integral_term_a integral_term_b=adapted_integral_term_b

After setting the integral terms, the sequence returns to step 216.

If, however, in step 216 the answer is negative, then the sequence proceeds to inquiry block 220. In this step, the controller determines whether the position error absolute value is greater than the position error threshold. The position error absolute value is determined by calculating the absolute difference between the present throttle position, as measured by the throttle position sensors 24*a*, and 24*b* and the desired throttle position corresponding to position command. The throttle position error threshold is the maximum amount of error allowed for the position error under which the integration element operates efficiently. A typical threshold has a magnitude of 1.25 degrees.

If in step 220 the position error absolute value is greater than the threshold, then the controller suspends integration pursuant to step 222. Then, the sequence immediately proceeds to inquiry block 224.

Pursuant to step 224, the controller determines whether the incrementing of the integral term has been suspended for more than the suspension time limit. A typical suspension time limit lasts for a contiguous period of 100 milliseconds. For a negative answer, the sequence returns to step 216.

To clarify, when the position error is large, the proportional and derivative control elements of the position feedback controller are controlling the electronic throttle 12. This large position error will substantially cause the integration element to start winding up if the integration element is active. Positioning performance is sacrificed when the integration element subsequently unwinds from the integration element wind-up because the integral term has increased in magnitude far beyond the target amount.

An affirmative answer suspends the integration element pursuant to the operation block 222 until the answer is negative. Further, inquiry block 224 includes a suspension time limit for the integration element. This time limit prevents the integration element from being eliminated from the electronic throttle position feedback controller 28 in the event a large throttle position error persists. Elimination from the electronic throttle position feedback controller 28 tends to happen when the proportional element of the electronic throttle position feedback controller 28 does not bring the throttle within the integration element active range. For example, the throttle position error range for suspending integration may require an absolute value of the throttle position error exceeding 1.25 degrees. The suspension time limit is preferably calibrated to activate the integration element immediately after the proportional and derivative elements pass the typical zero to ninety-five percent response time. The time limit also includes an internal timer that resets the time limit preferably when the position error goes through a sign change.

If, however, integration has been executed beyond the time limit, then the sequence proceeds to step 226. In inquiry block 226, a check is made as to whether the position rate absolute value is greater than the position rate threshold. The throttle position rate threshold is the maximum amount of error that can be associated with the integration element. A typical throttle position rate threshold is approximately 100 degrees per second.

To clarify, when the position rate is large, the proportional and derivative control elements of the position feedback controller 28 are controlling the electronic throttle 30, and this large position error will substantially cause the integration element to start winding up. Positioning performance is sacrificed when the integration element subsequently unwinds. For a positive answer, the integration element is suspended pursuant the operation block 228 until the answer is negative.

If in step 226 the position rate absolute value is greater than the position rate threshold, then the sequence proceeds to step 230. In step 230, the integration element of the throttle position feedback controller 28 is driven which generates the integration increment. Preferably, this portion of the controller operates by a determination of the position error element and the sign of position error element of the throttle position feedback controller. The sign of position error is determined by whether the throttle 30 position is greater than or less than the desired throttle position. Preferably also, a position error gain element of the throttle position feedback controller 28 is added. This gain element amplifies the position error. Preferably, a sign of position error gain element of the throttle position feedback controller 28 is also added. This gain element amplifies the sign of the position error.

In a preferred embodiment of the electronic throttle control system 10, from the operation block 230, the integration increment is generated by the following equation:

$$\text{internal_increment}=(\text{position_error}\times\text{KI})+[\text{sign}(\text{position_error})\times\text{KI_SIGN}]$$

In an alternate embodiment of the electronic throttle control system 10, from the operation block 230, the integration increment is generated by the following command:

$$\text{internal_increment}=\text{maximum}](\text{position_error}\times\text{KI}),\ \text{sign}(\text{position_error})\times\text{KI_SIGN})]$$

Following the generation of the integration increment in operation block 230, operation block 232 becomes active. Operation block 232 sets a maximum control effort by clipping both a maximum and a minimum of the integration element within a range of the maximum control effort. This is done because the system does not become substantially more effective operating outside of this range. The parameters are set by a determination of the parameters that the springs used for the throttle 16 operate most effectively without breakage or loss of spring torque.

Figure 3A:
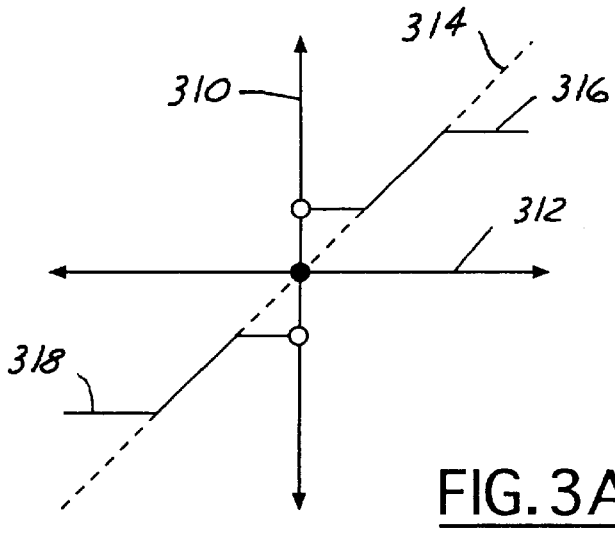
FIG. 3A is a graph illustrating the relationship between an integral increment and a position error absolute value of an adaptive spring torque calculation for an electronic throttle feedback controller in accordance with a preferred embodiment of the present invention.

FIG. 3A best illustrates the steps involved in operation blocks 230 and 232 in a preferred embodiment of the invention. The graph shows a relationship between the integration increment and the position error as prescribed by operation block 230. The graph further illustrates the operating regions of the integration increment according to operation block 232.

The vertical axis 310 is the output and shows the applied motor voltage. The horizontal axis 312 indicates the input and shows the position error in degrees. The classic integral gain 314 is shown as a diagonal line of a given slope. For example, the controller may value the integral gain at 56 volts/(degree second). Further, the integral term calculation is clipped to maximum and minimum values 316 and 318.

Figure 3B:
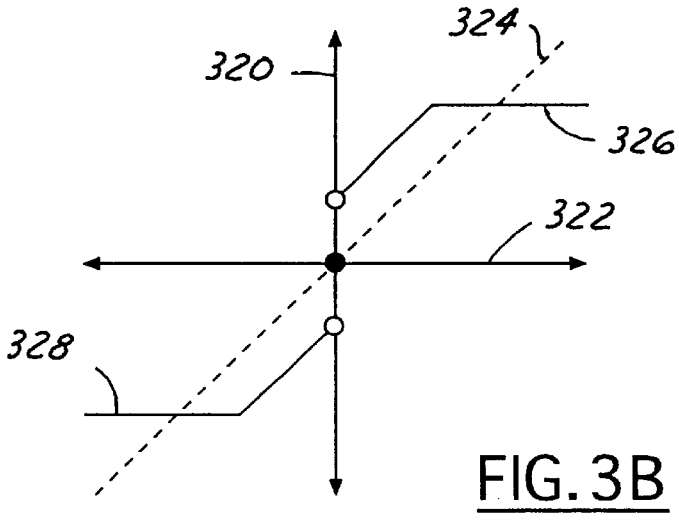
FIG. 3B is a graph illustrating the relationship between an integral increment and a position error absolute value of an adaptive spring torque calculation for an electronic throttle feedback controller in accordance with an alternate embodiment of the present invention.

FIG. 3B best illustrates the steps involved in operation blocks 230 and 232 in an alternate embodiment of the invention. According to operation block 230, the graph shows the relationship between the integration increment and the position error. Also, the maximum and minimum operating regions are shown as required by operation block 232. Similar to FIG. 3A, FIG. 3B shows a horizontal axis 320 indicating the input as a position error in degrees. The vertical axis 322 is the output and shows the applied motor voltage. The classic integral gain 324 is shown as a diagonal line of a given slope. Further, the integral term calculation is clipped to maximum and minimum values, 326 and 328.

Figure 2B:
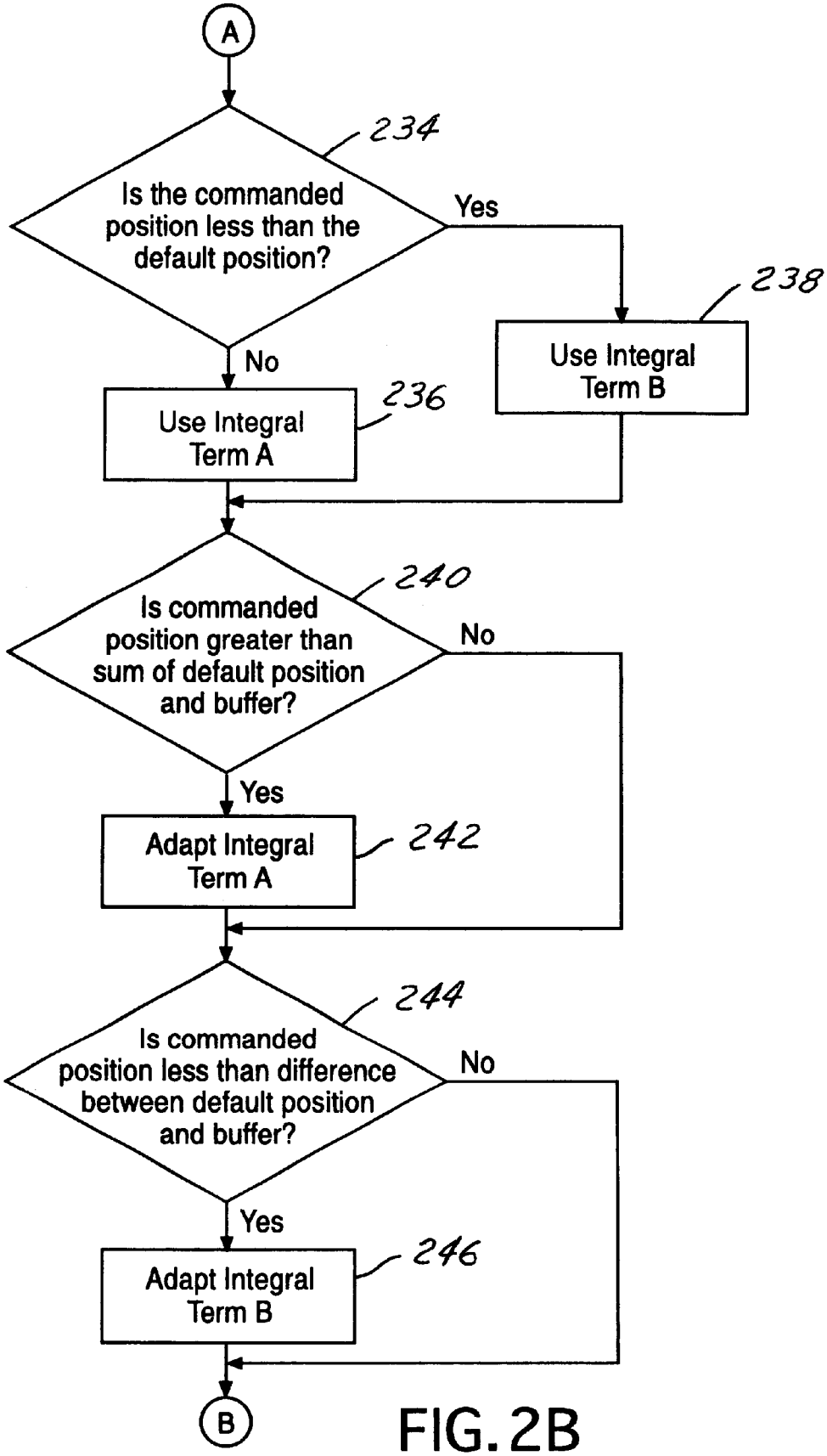
FIG. 2B is a second part of a logic flow diagram of an electronic throttle feedback controller for an electronic throttle control system, responsive to a throttle position command in accordance with one embodiment of the present invention.

Referring now to FIG. 2B, the sequence proceeds to step 234. In inquiry block 234, a check is made as to whether the throttle position command is less than the default position. If so, the logic continues to operation block 236, and the electronic throttle feedback controller 28 sets the terms of the integration element as the current integration upper limit term added to the integration increment. Otherwise, operation block 238 becomes active, and the electronic throttle feedback controller 28 sets the terms of the integration element as the current integration lower limit term added to the integration increment. The resetting of the integration element terms assures that an integrator value resulting from use above default is not used below default for which it would be inappropriate.

Once the electronic throttle feedback controller 28 has set the terms of the integration element, the sequence proceeds to step 240. In step 240, the controller 28 determines whether the commanded position is greater than the sum of a default position and a buffer. If the answer is positive, then the sequence proceeds to step 242.

Pursuant to step 242, an integral term A is adapted to compensate for the spring torque. The controller adapts integral term A by the following command:

$$\text{adapted_integral_term_a}_k=](\alpha)\times(\text{adapted_integral_term_a}_{k-1})]+[(1-\alpha)\times(\text{integral_term_a}_k)]$$

If, however, the commanded position is less in step 240, then the sequence proceeds to step 244. In step 244, the controller 28 determines whether the commanded position is less than a difference between a default position and a buffer. If the commanded position is less, then the sequence proceeds to step 246. In step 246, the integral term B is adapted to compensate for spring torque. Otherwise, if the position command is greater than the difference between the default position and the buffer, then the sequence returns to step 216.

In operation, the present invention learns the current required to oppose the spring torque and then sums that term into the calculated control action. The term that opposes the spring torque can either be a function of throttle position or throttle command. One skilled in the art would recognize that instead of current, voltage or duty cycle might be used.

Figure 4:
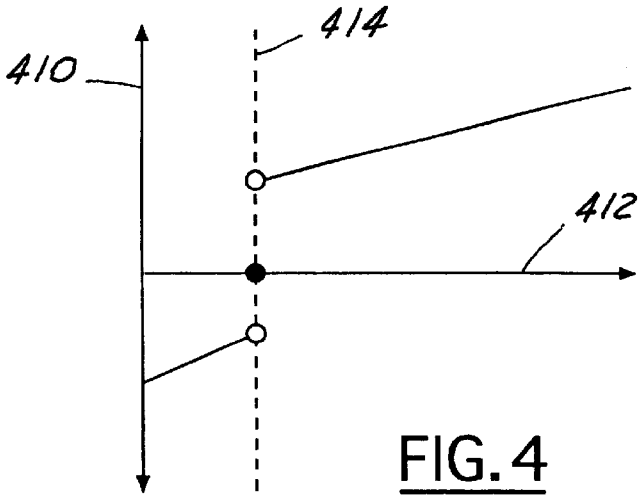
FIG. 4 is a graph illustrating the relationship between a spring torque and a throttle position for an electronic throttle feedback controller in accordance with one embodiment of the present invention.

FIG. 4 illustrates the relationship between spring torque and the throttle position according to the present invention. The vertical axis 410 indicates the output of motor voltage, positioning effort, in volts. The horizontal axis 412 shows the input of throttle command in degrees.

The feedforward term is determined by the position of the throttle plate in relation to the default position 414. When the throttle plate command is coincident with the default position 414, the feedforward term is zero. When the throttle plate position is greater than the default position 414, the feedforward term is based on the adapted value A. In a preferred embodiment, only the offset is adapted. However, a person skilled in the art would understand that both the offset and slope may be adapted. Although adapting both the offset and slope may increase performance, the system may become more complex. When the throttle plate command is less than the default position 414, the feedforward term is based on the adapted value B.

The present invention thus achieves an improved and reliable electronic throttle spring torque adaptation system by learning the current required to oppose the spring torque and summing that term into the calculated control action. The present invention does this without dependence on an estimate of spring torque or spring torque variation. Additionally, the present invention automatically adjusts the controller for changes in electronic throttle spring torque and changes in throttle motor temperature.

From the foregoing, it can be seen that there has been brought to the art a new and improved electronic throttle spring torque adaptation system. It is to be understood that the preceding description of the preferred embodiment is merely illustrative of some of the many specific embodiments that represent applications of the principles of the present invention. Clearly, numerous and other arrangements would be evident to those skilled in the art without departing from the scope of the invention as defined by the following claims.

What is claimed is:

1. A method for controlling a positioning device of an internal combustion engine, the positioning device having a spring bias torque, the method comprising the steps of:

providing an electric motor for actuating the positioning device against the spring bias torque;

actuating the positioning device using said electric motor;

learning a motor effort required to oppose the spring bias torque;

summing said motor effort with a spring opposition term into a calculated control action; and controlling said electric motor based upon said calculated control action.

2. The method as recited in claim 1, wherein said motor effort is current.

3. The method as recited in claim 1, wherein said motor effort is voltage.

4. The method as recited in claim 1, wherein said motor effort is duty cycle.

5. The method as recited in claim 1, wherein said spring opposition term is a function of a throttle position command.

6. The method as recited in claim 1, wherein said spring opposition term is a function of a throttle position.

7. A method for controlling a positioning device of an internal combustion engine, the positioning device having a spring bias torque, the method comprising the steps of:

providing an electric motor for actuating the positioning device against the spring bias torque;

supplying a first current to said electric motor to move the positioning device to an actual position;

comparing said actual position to a requested position;

monitoring said first current to determine a required current for opposing the spring bias torque at said actual position;

summing said requested position with a spring opposition term based upon said required current into an adjusted requested position; and supplying said required current to said electric motor to move the positioning device to an adjusted requested position.

8. The method as recited in claim 7, wherein the step of supplying said first current to said electric motor to move the positioning device to an actual position comprises supplying a first voltage to said electric motor.

9. The method as recited in claim 7, wherein the step of supplying said first current to said electric motor to move the positioning device to an actual position comprises supplying a first pulse width modulated signal to said electric motor.

10. The method as recited in claim 7, wherein the step of monitoring said first current to determine a required current to oppose said spring torque at said actual position comprises monitoring a first voltage to said electric motor.

11. The method as recited in claim 7, wherein the step of monitoring said first current to determine said required current to oppose said spring torque at said actual position comprises supplying a first pulse width modulation signal to said electric motor.

12. A method for controlling a positioning device of an internal combustion engine, the positioning device having a spring bias torque, the method comprising the steps of:

providing an electric motor for actuating the positioning device against the spring bias torque;

supplying a first voltage to said electric motor to move the positioning device to an actual position;

comparing said actual position to a requested position;

monitoring said first voltage to determine a required voltage for opposing the spring bias torque at said actual position;

summing said requested position with a spring opposition term based upon said required current into a adjusted requested position; and supplying said required voltage to said electric motor to move the positioning device to an adjusted requested position.

13. The method as recited in claim 12, wherein the step of supplying said first voltage to said electric motor to move the positioning device to an actual position comprises supplying a first current to said electric motor.

14. The method as recited in claim 12, wherein the step of supplying said first voltage to said electric motor to move the positioning device to an actual position comprises supplying a first pulse width modulated signal to said electric motor.

15. The method as recited in claim 12, wherein the step of monitoring said first voltage to determine a required current to oppose said spring torque at said actual position comprises monitoring a first current to said electric motor.

16. The method as recited in claim 12, wherein the step of monitoring said first voltage to determine said required current to oppose said spring torque at said actual position comprises supplying a first pulse width modulation signal to said electric motor.

* * * * *